US009341033B1

(12) United States Patent
Jennings

(10) Patent No.: US 9,341,033 B1
(45) Date of Patent: May 17, 2016

(54) RISER TENSIONER ASSEMBLY

(71) Applicant: Phyllis Jennings, Tomball, TX (US)

(72) Inventor: Charles E. Jennings, Tomball, TX (US)

(73) Assignee: Phyllis A. Jennings, Tomball, TX (US)

( * ) Notice: Subject to any disclaimer, the term of this patent is extended or adjusted under 35 U.S.C. 154(b) by 93 days.

(21) Appl. No.: 14/457,389

(22) Filed: Aug. 12, 2014

Related U.S. Application Data

(60) Provisional application No. 61/958,983, filed on Aug. 12, 2013.

(51) Int. Cl.
*E21B 7/12* (2006.01)
*E21B 19/00* (2006.01)
*E21B 17/01* (2006.01)

(52) U.S. Cl.
CPC ..... *E21B 19/006* (2013.01); *E21B 17/01* (2013.01)

(58) Field of Classification Search
CPC ..... E21B 19/004; E21B 19/006; E21B 19/10
USPC ..... 166/355, 367; 405/224.2, 224.4
See application file for complete search history.

(56) References Cited

U.S. PATENT DOCUMENTS

| | | | | |
|---|---|---|---|---|
| 9,181,761 | B2 * | 11/2015 | Hafernik et al. | |
| 2005/0147473 | A1 * | 7/2005 | Pallini et al. | 405/224.4 |
| 2006/0280560 | A1 * | 12/2006 | Ellis et al. | 405/223.1 |
| 2012/0207550 | A1 * | 8/2012 | Aksel et al. | 405/224.4 |

* cited by examiner

*Primary Examiner* — Matthew R Buck
*Assistant Examiner* — Aaron Lembo
(74) *Attorney, Agent, or Firm* — Buskop Law Group, PC; Wendy Buskop

(57) ABSTRACT

A riser tensioner system for offsetting heave and yaw between the riser and the rig on offshore drilling and production platforms during drilling and production operations. A plurality of hydraulic cylinders are connected by a spider. The spider allows individual cylinders to be disconnected from the riser, suspended in place with equipment integral to the riser system, without cranes, and can be repaired without loosening bolts or screws and without wrenches or torque wrenches. Maintenance can take place on one cylinder without disturbing other cylinders supporting the riser. The cylinders can be oriented in a vertical arranged or slanted in an upper end in an inverted cone or "A" frame orientation.

16 Claims, 7 Drawing Sheets

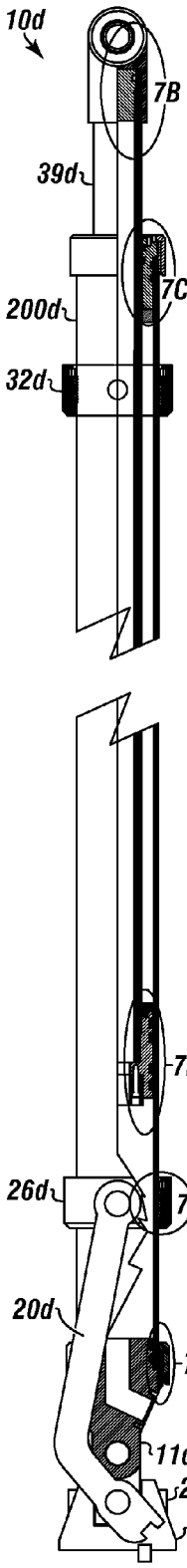
FIGURE 7A
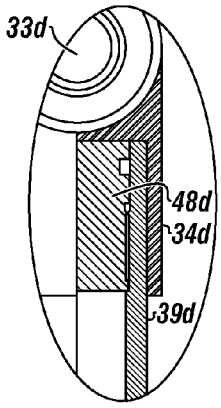
FIGURE 7B
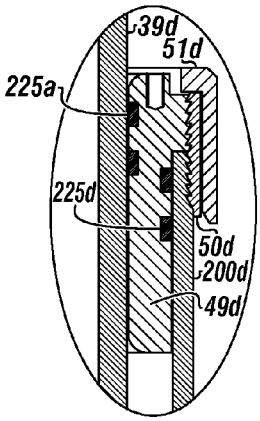
FIGURE 7C
FIGURE 7D
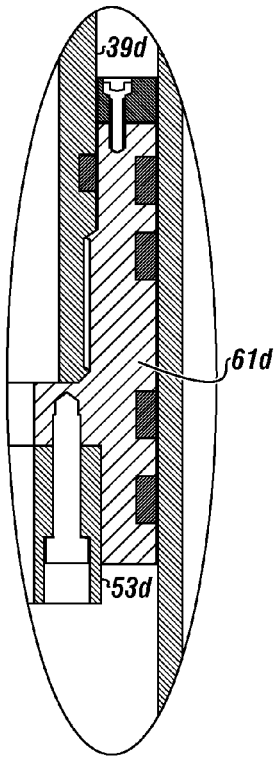
FIGURE 7E
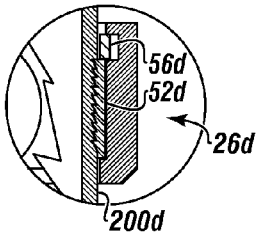
FIGURE 7F
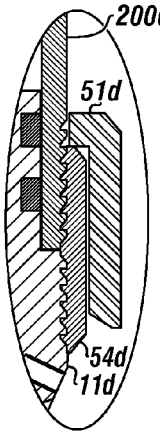

RISER TENSIONER ASSEMBLY

CROSS REFERENCE TO RELATED APPLICATIONS

The present application claims priority to and the benefit of U.S. Provisional Patent Application Ser. No. 61/958,983 filed on Aug. 12, 2013, entitled "SMART EASY MAINTENANCE RISER TENSIONER SYSTEM." This reference is hereby incorporated in its entirety.

FIELD

The present embodiments generally relate to a ram style or tension style riser tensioner assembly for offshore use.

BACKGROUND

A need exists for a tensioner assembly with higher reliability than commercially available systems.

The present embodiments meet this need.

BRIEF DESCRIPTION OF THE DRAWINGS

The detailed description will be better understood in conjunction with the accompanying drawings as follows:

FIG. 7A depicts a hydraulic cylinder.

FIG. 7B depicts a detail of the cylinder piston rod with rod end clevis, internal sealing plug and clevis pin.

FIG. 7C depicts the cylinder piston rod with a rod bearing end cap with a plurality of seals and slide rings.

FIG. 7D depicts the cylinder piston rod being pushed by a hollow piston rod.

FIG. 7E depicts the hub assembly.

FIG. 7F depicts the barrel and end cap with a two sets of teeth retainer embodiment for a one piece retainer ring.

Figure 2A:
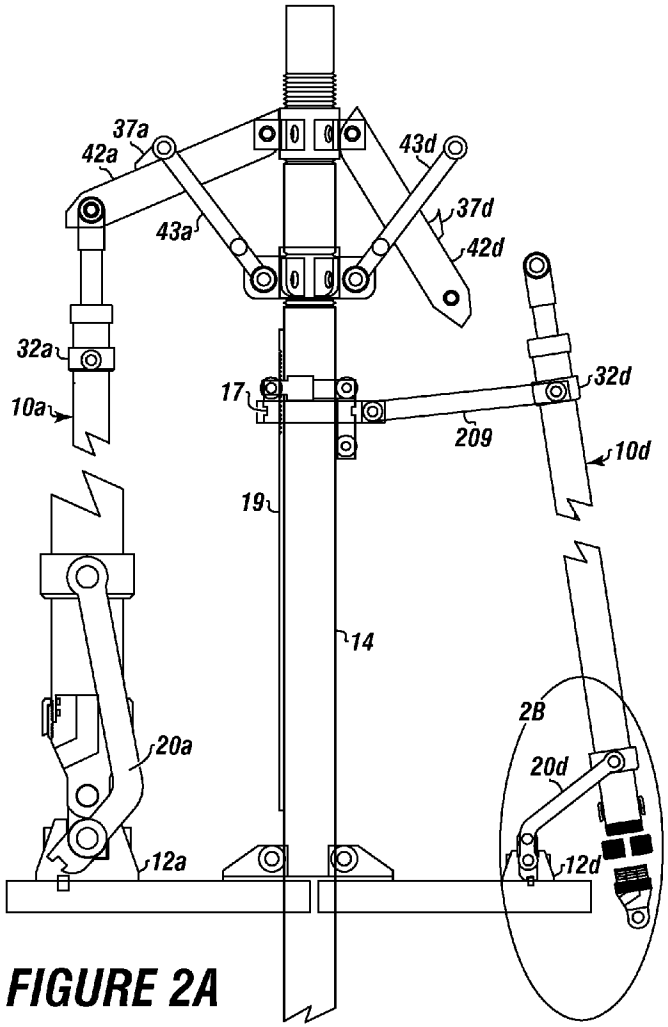
FIG. 2A depicts the moving tractor mounted to the riser.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Offshore platforms are designed and built to provide a means to drill, explore and produce hydrocarbons in seawater.

Some of these operations are performed from jack-up rigs supported by rigid legs extending from the platform to the ocean floor in water depths of up to 350 feet. These platforms are stable relative to ocean wave action but are limited to the water depth in which they can operate.

In deeper water, drill ships, semisubmersibles, SPARS™ or tension leg platforms are used with the majority of these operations taking place from drill ships and semisubmersibles.

In all but the jack-up rigs, water disturbances present a serious problem between the rig and the riser which ends at the ocean floor.

Because of rig heave and yaw, riser tensioners are required on the rig deck which consist of an arrangement of tensioner cylinders and nitrogen over hydraulic fluid, to produce a shock absorber effect, so that as the rig heaves up and down, the riser is kept relatively level in order to prevent damage to the riser and other equipment at the ocean floor.

Existing tensioners are made with four or more long stroke hydraulic cylinders arranged in a push-up ram style configuration or a pull-up tension design. The deeper the water the rig is operating in, the longer the stroke of the cylinder rod in general, this allows the tensioner to take up more slack in the riser system.

An accumulator with fluid and nitrogen is typically provided with enough fluid to push the piston to the end of its stroke if needed. However, with accumulators, the further out the rod strokes, the more the pressure drops, as demonstrated in gas calculations according to Boyle's law.

Riser tensioner cylinders are designed in either the ram or tension types and can be arranged around the riser in the near vertical arrangement or the tensioner cylinders can be angled radially inward to the riser at the upper end, forming an inverted cone shape, and when conventional tensioner cylinders need repair like having the seals and bearings replaced, they have to be removed completely from the riser pattern with a crane, and have another tensioner cylinder moved into its place and connected.

This repair can take from one to several days depending on the availability of the replacement tensioner cylinders.

A riser tensioner to be used on offshore floating platforms is a motion absorber, between the riser, extending from the ocean floor and the floating platform. The riser tensioner assemblies allow a floating platform supporting the riser to yaw and move with the swells and heaves of the ocean without over stressing the riser and equipment on the ocean floor.

The tensioner assembly described herein has the benefit of having easy maintenance to the tensioner cylinders, rods and pistons without removing the tensioner cylinders from their respective position in the position pattern.

In embodiments, from 4 to 12 tensioner cylinders can be placed into the riser support pattern, one half of them attached to each side of at least one sliding deck plate.

The embodiments relate to a vertical style riser tensioner assembly with a variety of components. The assembly works on a riser mounted through an opening in the center of a sliding plate or between a plurality of sliding deck plates, which is supported by a plurality of roller assemblies disposed around the riser, stabilizing the riser.

The embodiments can include a spider mounted to the riser. The spider can provide compressive upper tensile load transfer. The spider can have a spider retaining bracket surrounding the riser. The spider can have a plurality of pivoting push beams connected to the spider retaining bracket. The spider can have a riser tensile rod bracket mounted around the riser between the spider retaining bracket and a sliding deck plate.

A plurality of tensile rods can be used, with each tensile rod slidably engaging a pivoting push beam.

A plurality of hydraulic cylinders can be connected to the spider. Each hydraulic cylinder can include a barrel, a cylinder piston rod sliding in the barrel, engaging one of the pivoting push beams of the spider. The hydraulic cylinders can each have an end cap mounted to it. Each hydraulic cylinder can have a hub assembly surrounding the barrel of the hydraulic cylinder.

A moving tractor can be movably mounted to the riser between the spider and one of the sliding deck plates. The moving tractor can connect to an air gear motor mounted to the riser for moving individually selectable hydraulic cylinders between an operational location to a maintenance location.

The air gear motor can be connected to at least one system accumulator that supplies gas to each hydraulic cylinder to extend or retract the cylinder piston rod in the barrel.

In embodiments, a plurality of pivot arms can be used, with one of the pivot arms connected between one of the hub assemblies.

A universal pivot assembly can be mounted to one of the sliding deck plates. In embodiments each pivot arms moves in tandem with the moving tractor for moving the hydraulic cylinder of choice between an operational location and a maintenance location.

In embodiments, a plurality of upper hubs can be used. Each upper hub can surround the barrel of one of the hydraulic cylinders, to suspend the hydraulic cylinders when a cylinder piston rod is disconnected from one of the pivoting push beam of the spider.

In embodiments, a plurality of disconnectable arms can be used. Each disconnectable arm can connect between one of the upper hubs of a hydraulic cylinder and the moving tractor, enabling the pivoting push beams on the spider to move and at least one cylinder rod to be retracted allowing the hydraulic cylinder to drop down and outward when a pivot arm is swung out without using the moving tractor.

Figure 1:
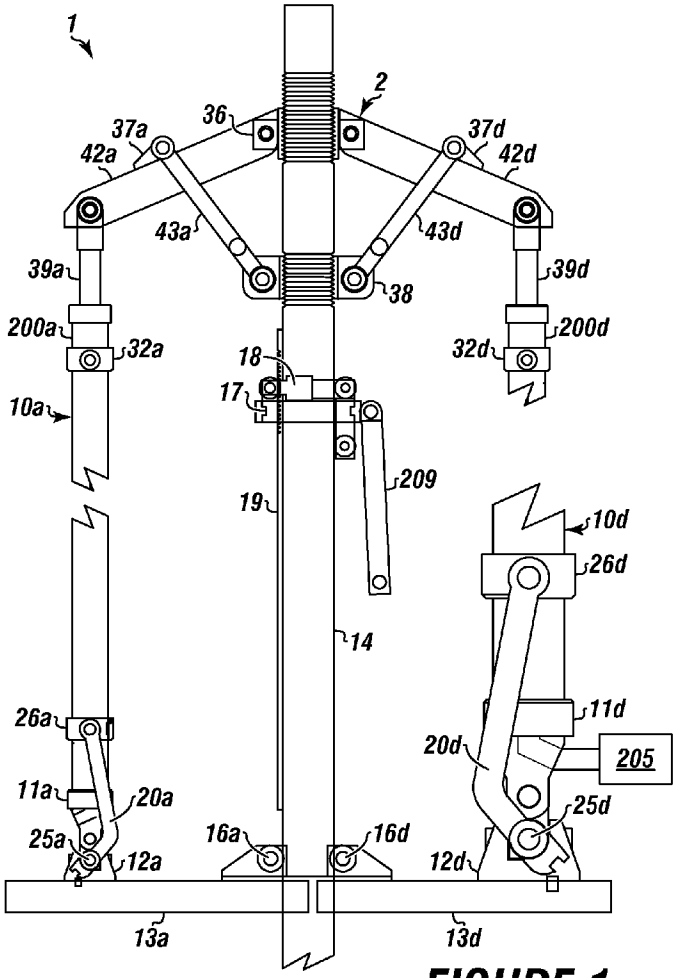
FIG. 1 depicts a portion of a riser tensioner assembly.

Turning now to the Figures, FIG. 1 depicts a portion of a riser tensioner assembly 1 having a riser 14 with a spider 2 mounted to the riser 14.

The riser tensioner assembly can be a vertical style riser tensioner assembly with six hydraulic cylinders. Two hydraulic cylinders 10*a* and 10*d* are shown. The hydraulic cylinders can be mounted to sliding deck plates 13*a* and 13*d*.

Cylinder end caps 11*a* and 11*d* can connect each cylinder respectively to a universal pivot assembly 12*a* and 12*d*. Each universal pivot assembly can use a retainer pin 25*a* and 25*d* respectively.

The universal pivot assemblies can be fastened to the sliding deck plates which form the rig deck.

The riser 14 can be retained in an opening between the sliding deck plates using a plurality of roller assemblies 16*a* and 16*d* which can also be mounted to the sliding deck plates.

Load can be applied to the riser 14 through the plurality of hydraulic cylinders simultaneously and in sequence.

Each hydraulic cylinder can have a cylinder piston rod 39*a* and 39*d*.

Each hydraulic cylinder can be positioned at 180 degrees from another hydraulic cylinder in an operational location which is essentially a working position. All of the hydraulic cylinders can be connected to the spider 2 using a spider retaining bracket 36. The spider retaining bracket 36 can surround the riser 14.

A plurality of pivoting push beams 42*a* and 42*d* can connect with the spider retaining bracket 36.

A riser tensile rod bracket 38 can connect to each of a plurality of tensile rods 43*a* and 43*d*. Each tensile rod can slide over a pivoting push beam.

A compressive force can be applied to the riser 14 through spider retaining bracket 36 and a tensile load can be applied to a riser tensile rod bracket 38 surrounding the riser through the plurality of tensile rods simultaneously and in sequence.

A moving tractor 17 can connect to and lift each of the hydraulic cylinders individually for moving the cylinders from an operational location to a maintenance location.

The moving tractor 17 can be powered by an air gear motor 18 riding on a rack 19.

The air gear motor 18 can connect with at least one disconnectable arm 209. The disconnectable arm 209 can engage an upper hub 32*a* and 32*d* on each hydraulic cylinder.

A plurality of pivot arms 20*a* and 20*d* can be used to move the cylinders individually from an operational location to a maintenance location.

The pivot arms can each connect to a hub assembly 26*a* and 26*d*. Each hub assembly can mount around the barrel of the hydraulic cylinder. Barrels 200*a* and 200*d* are shown.

At least one accumulator 205 can provide gas to the hydraulic cylinders.

In embodiments, the accumulators, which can be gas pressure vessels, can operate the air gear motor and be a backup power source, in which case the vessel does not have to be the primary source of air supply.

In an embodiment, a plurality of stops 37*a* and 37*d* can be installed, one stop for each tensile rod. When the plurality of stops are engaged, a rigid lift frame for the riser can be formed by the interlocked the plurality of tensile rods with the plurality of pivoting push beams using the plurality of stops.

FIG. 2A depicts the moving tractor 17 mounted to the riser 14 for moving on a rack 19. The rack 19 can be mounted to the riser allowing the air gear motor and moving tractor to move longitudinally along the riser.

Hydraulic cylinders 10*a* and 10*d* are shown. Hydraulic cylinder 10*d* can be supported by the moving tractor 17 using the disconnectable arm 209.

Upper hubs 32*a* and 32*d* are shown. Upper hub 32*d* is shown surrounding hydraulic cylinder 10*d* and engaging the disconnectable arm 209.

Two of the plurality of stops 37*a* and 37*d* are shown. One stop is shown for each pivoting push beam. When the stops are engaged, a rigid lift frame for the riser is formed by interlocking the plurality of tensile rods 43*a* and 43*d* with the plurality of pivoting push beams 42*a* and 42*d*.

The hydraulic cylinder 10*d* is depicted as un-pinned from a universal pivot assembly 12*d* and the hydraulic cylinder is shown swung radially outward on pivot arm 20*d*.

Hydraulic cylinder 10*a* is depicted in an operational location with pivot arm 20*a* in a different orientation as connected to the universal pivot assembly 12*a*.

Figure 2B:
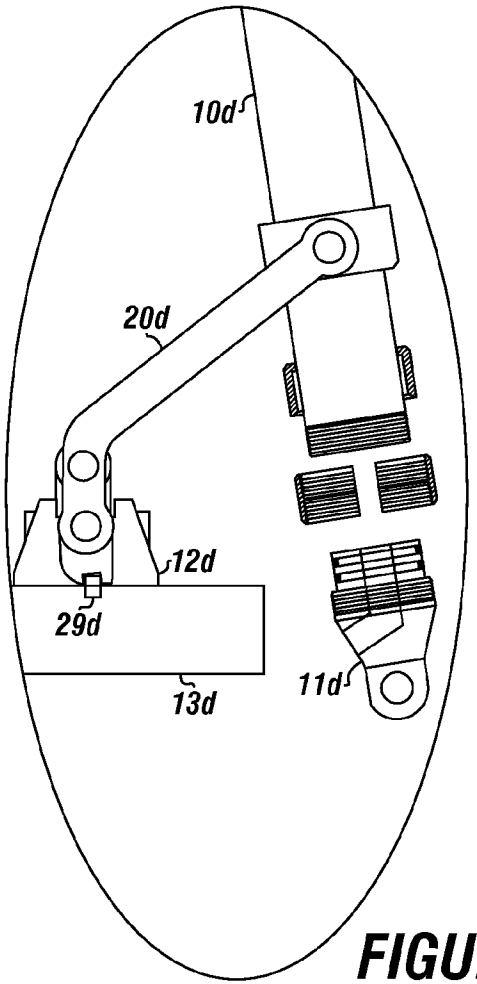
FIG. 2B depicts a detail of the pivot arm from FIG. 2A.

FIG. 2B depicts a detail of the pivot arm from FIG. 2A.

The pivot arm 20*d* can engage a detent pin 29*d*. The detent pin 29*b* can be projecting up from sliding deck plate 13*d*.

An end cap 11*d* can be removed from hydraulic cylinder 10*d* when the hydraulic cylinder is uncoupled from universal pivot assembly 12*d*. Once uncoupled, the pivot arm 20*d* carrying hydraulic cylinder 10*d* can be swung radially outward supported by the pivot arm.

Figure 3:
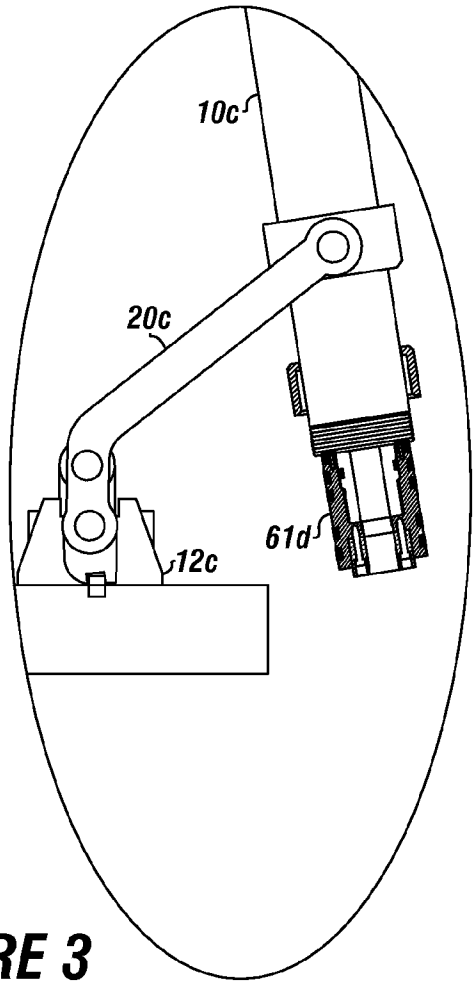
FIG. 3 depicts a detail view of a hydraulic cylinder disconnected from a universal pivot assembly.

FIG. 3 depicts a detail view of a hydraulic cylinder 10*c* disconnected from a universal pivot assembly 12*c* with a retainer pin removed and the hydraulic cylinder swung away from the universal pivot assembly 12*c* using pivot arm 20*c*. A hollow piston rod 61*d* is shown extending from the barrel of the hydraulic cylinder, such as for repair.

Figure 4:
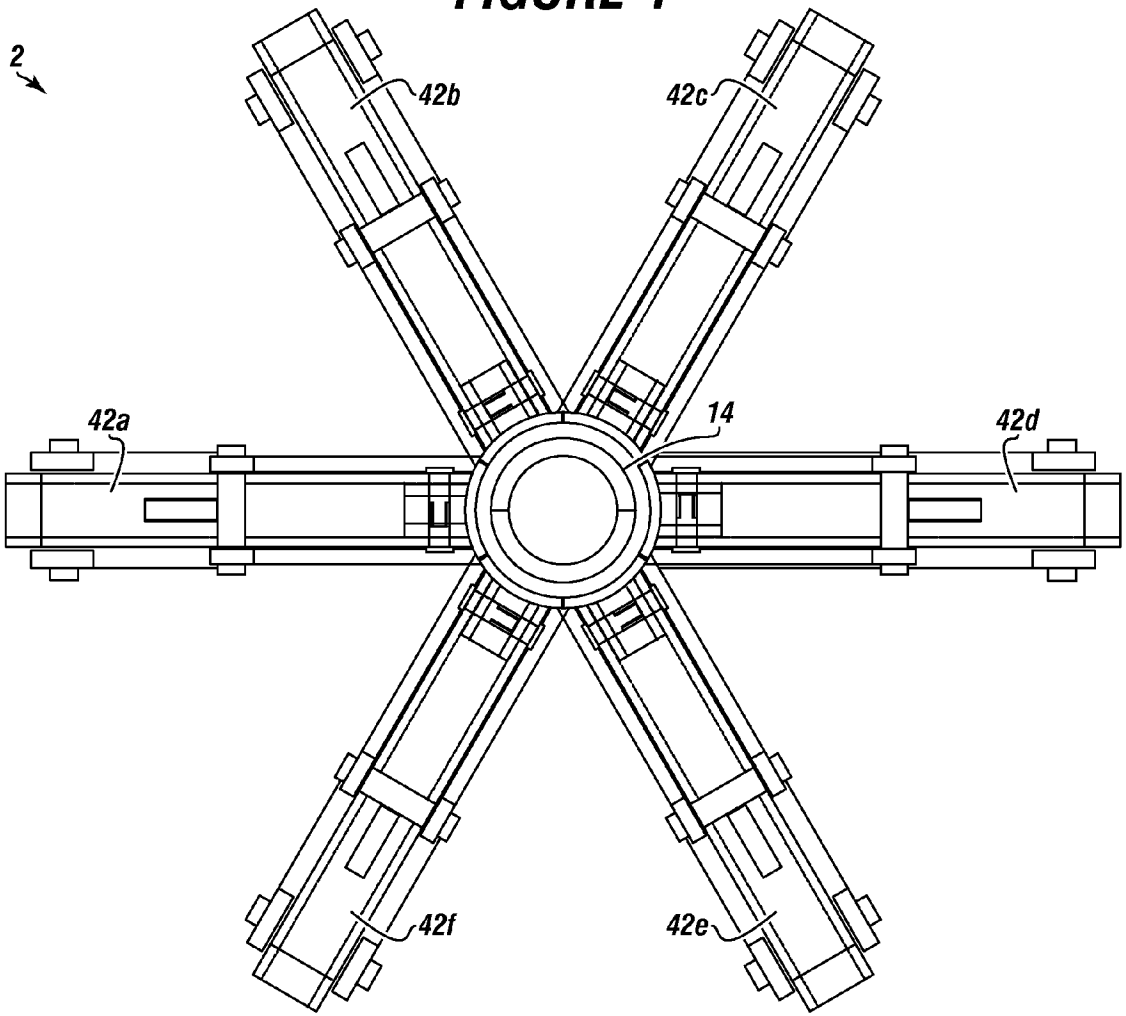
FIG. 4 depicts a top plan view of the spider.

FIG. 4 depicts a top plan view of the spider 2. The spider 2 can provide compressive upper tensile load transfer, from the deck via the hydraulic cylinders, simultaneously and in sequence. This spider 2 can comprise a plurality of pivoting push beams 42*a*-42*f* mounted around a riser 14.

Figure 5B:
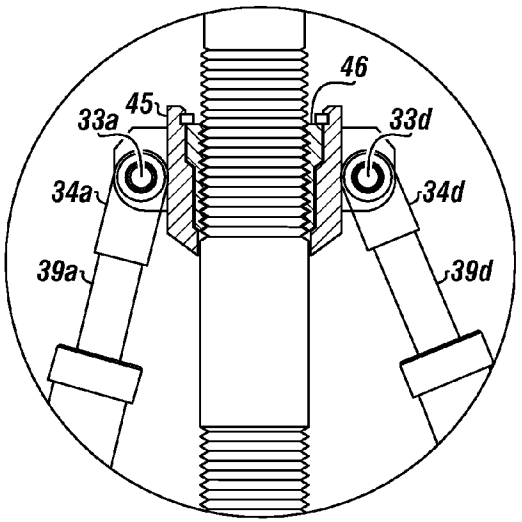
FIG. 5B depicts a detail view of the piston rods with rod end devises.
Figure 5A:
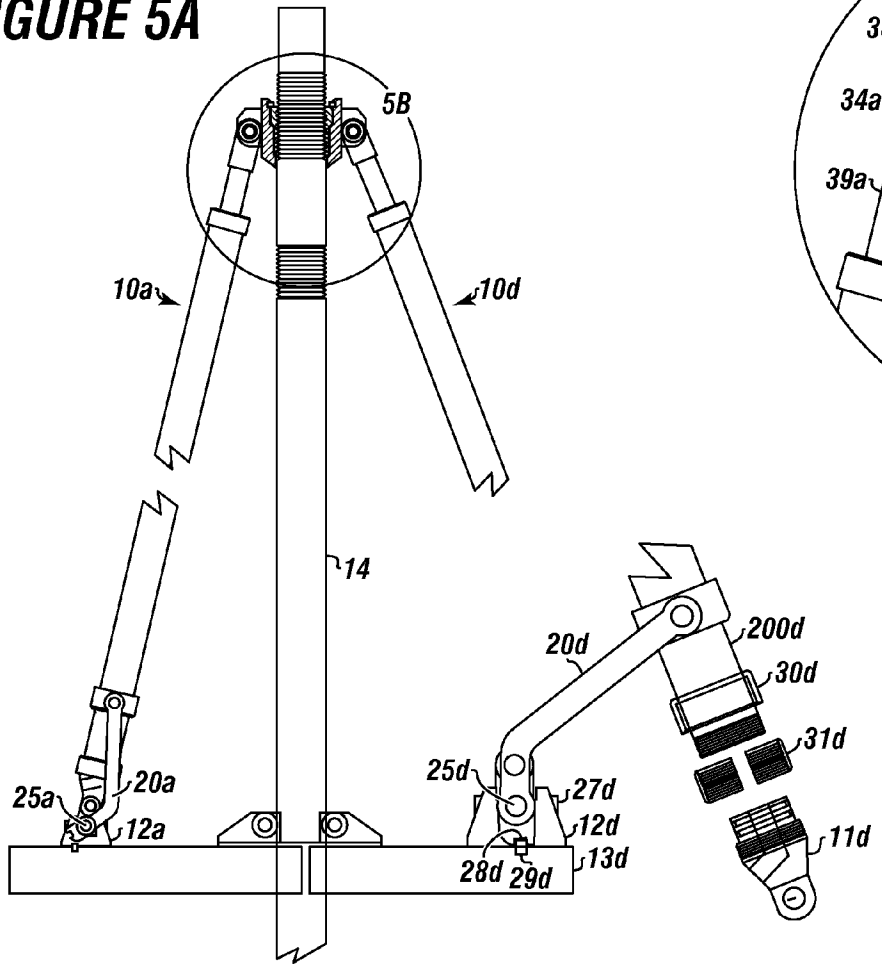
FIG. 5A depicts an "A" frame or cone arrangement of two hydraulic cylinders around a riser.

FIG. 5A depicts an "A" frame or cone arrangement of two hydraulic cylinders 10*a* and 10*d* around a riser 14.

Each of the pivot arms 20*a* and 20*d* can be connected to a universal pivot assembly 12*a* and 12*d* connected to a sliding deck plate 13*d*.

Hydraulic cylinder 10*d* can be moved to a maintenance location with locking assembly retainer ring 30*d* on the barrel 200*d* and teethed lock ring 31*d* for connecting the end cap 11*d* into the barrel 200*d*.

A lock notch 28*d* can be on the pivot arm 20*d* for engaging detent pin 29*d*. The detent pin 29*d* can be mounted on the sliding deck plate 13*d*. The detent pin can be spring actuated.

When a retainer pin 25*d* that connects a hydraulic cylinder end cap to the universal pivot assembly 12*d* is removed, the lower end of the hydraulic cylinder can be moved radially out and away from the riser. The spring actuated detent pin 29*d* can engage the lock notch 28*d* and lock the disconnected end of the hydraulic cylinder rigidly out away from the riser. Retainer pin 25*a* is also shown.

In another embodiment, the lock notch 28*d* can enable the hydraulic cylinder to be locked away from universal pivot assembly 12*d*, enabling the end cap 11*d* to be removed for replacing of seals in the hydraulic cylinder.

A lower hub 27*d* is shown engaging one of the pivot arms 20*b*

FIG. 5B depicts a detail view of the piston rods with rod end devises.

The piston rods 39*a* and 39*d* can connect to the rod end devises 34*a* and 34*d*. A clevis pin 33*a* and 33*d* can connect each rod end clevis to the riser push bowl 45 with a ribbed ring 46.

Figure 6:
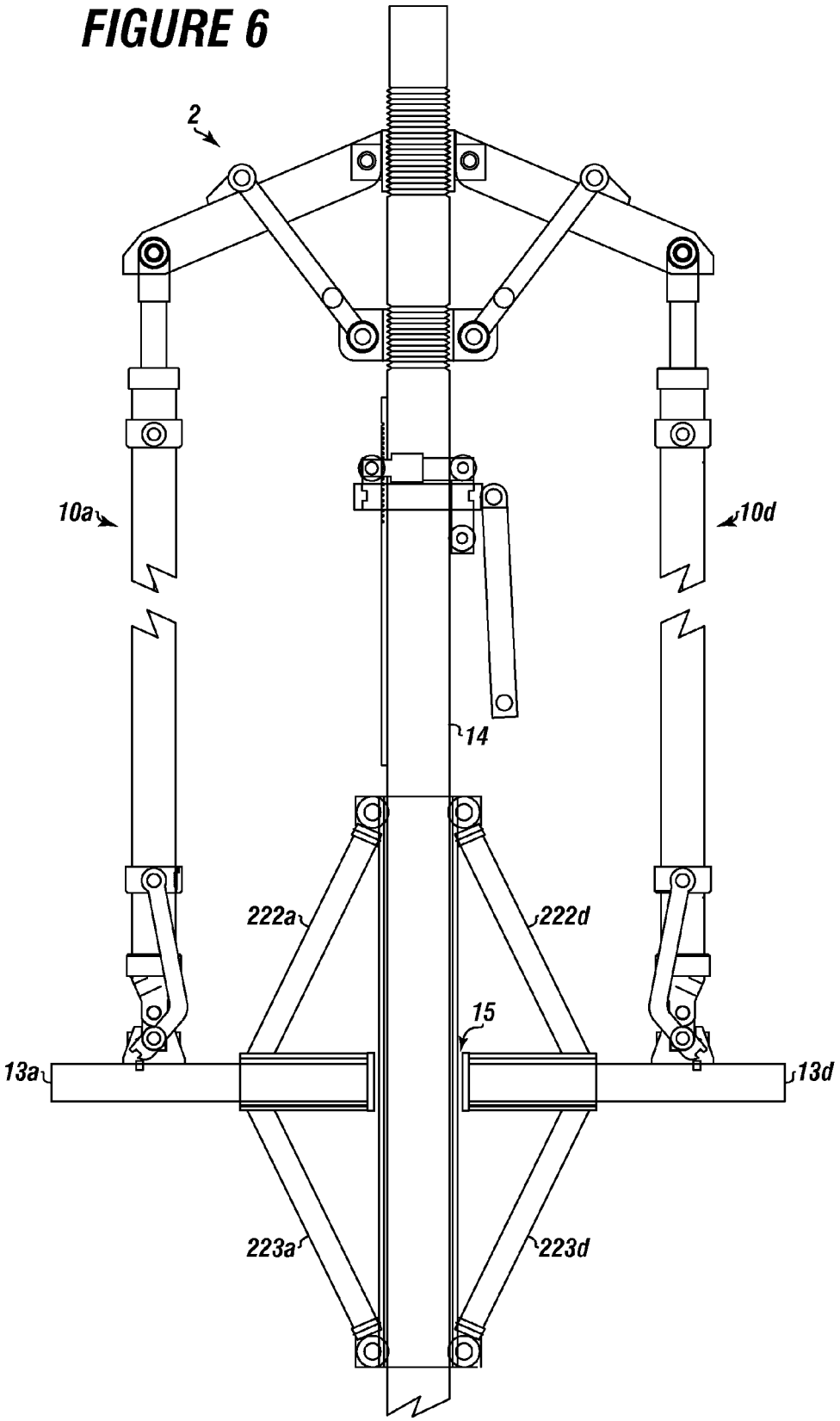
FIG. 6 depicts another embodiment of the invention with the spider connected to hydraulic cylinders around a riser.

FIG. 6 depicts another embodiment of the invention with the spider 2 connected to hydraulic cylinders 10*a* and 10*d* around a riser 14.

The riser 14 can have a plurality of top stabilizer beams 222*a* and 222*d*, each connected between the riser 14 and a side of one of the sliding deck plate 13*a* and 13*d*.

A plurality of bottom stabilizer beams 223*a* and 223*d* can each connect to the riser and to an opposite side of one of the sliding deck plates 13*a* and 13*d* from the top stabilizer beams.

The riser 14 is shown mounted through a center hole 15 in the sliding deck plate.

FIG. 7A depicts a hydraulic cylinder.

The hydraulic cylinder 10*d* can comprise a cylinder piston rod 39*d* extending from a barrel 200*d*. An upper hub 32*d* can be mounted around the barrel. A pivot arm 20*d* can connect to a hub assembly 26*d* and a universal pivot assembly 12*d*. An end cap 11*d* can be installed on the hydraulic cylinder. A lower hub 27*d* is also depicted.

FIG. 7B depicts a detail of the cylinder piston rod 39*d* with rod end clevis 34*d*, internal sealing plug 48*d* and clevis pin 33*d*.

FIG. 7C depicts the cylinder piston rod 39*d* with a rod bearing end cap 49*d* with a plurality of seals 225*a*-225*d* and slide rings.

The rod bearing end cap 49*d* can be retained in place by two sets of teeth on a lock ring 50*d*, locked in a matching groove in the upper outer diameter of the barrel 200*d* of the hydraulic cylinder. A one piece retaining ring 51*d* slips over the lock ring 50*d* to hold the assembly together. The lock ring 50*d* can be a two piece teethed lock ring.

FIG. 7D depicts the cylinder piston rod 39*d* being pushed by a hollow piston rod 61*d* which can be driven by air from at least one of the accumulators.

A bump ring 53*d* can absorb shock if the piston bottoms out in the hydraulic cylinder 10*d* against the end cap.

FIG. 7E depicts the hub assembly 26*d* mounted around the barrel 200*d* for the hydraulic cylinder with a one set of teeth ring 52*d*. A retainer ring can be slid over the one set of teeth ring 52*d* from the bottom of the hydraulic cylinder and retained by a spring ring 56*d*.

FIG. 7F depicts the barrel 200*d* and end cap 11*d* with a two sets of teeth retainer 54*d* embodiment for a one piece retainer ring 51*d*.

Figure 8:
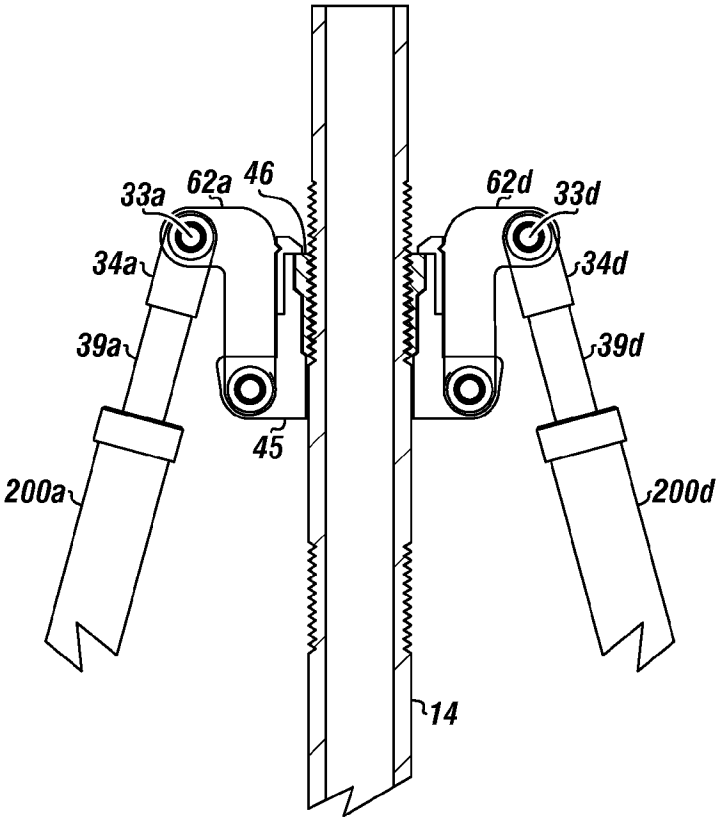
FIG. 8 depicts two of the plurality of short pivoting push arms pinned to rod end devises.

FIG. 8 depicts two of the plurality of short pivoting push arms 62*a* and 62*d* pinned to rod end devises 34*a* and 34*d* respectively.

The devises can secure to the riser 14 through the riser push bowl 45 with its ribbed ring 46.

The rod end devises 34*a* and 34*d* can also connect to cylinder piston rods 39*a* and 39*d* as they extend from barrels 200*a* and 200*d*.

In this embodiment, each rod end clevis can engage a clevis pin 33*a* and 33*d* respectively. The clevis pins can allow one of the pivoting push arms to push the respective hydraulic cylinder outward and away from the riser allowing a lower end of the hydraulic cylinder to pivot outward with the pivoting push arm.

Figure 9:
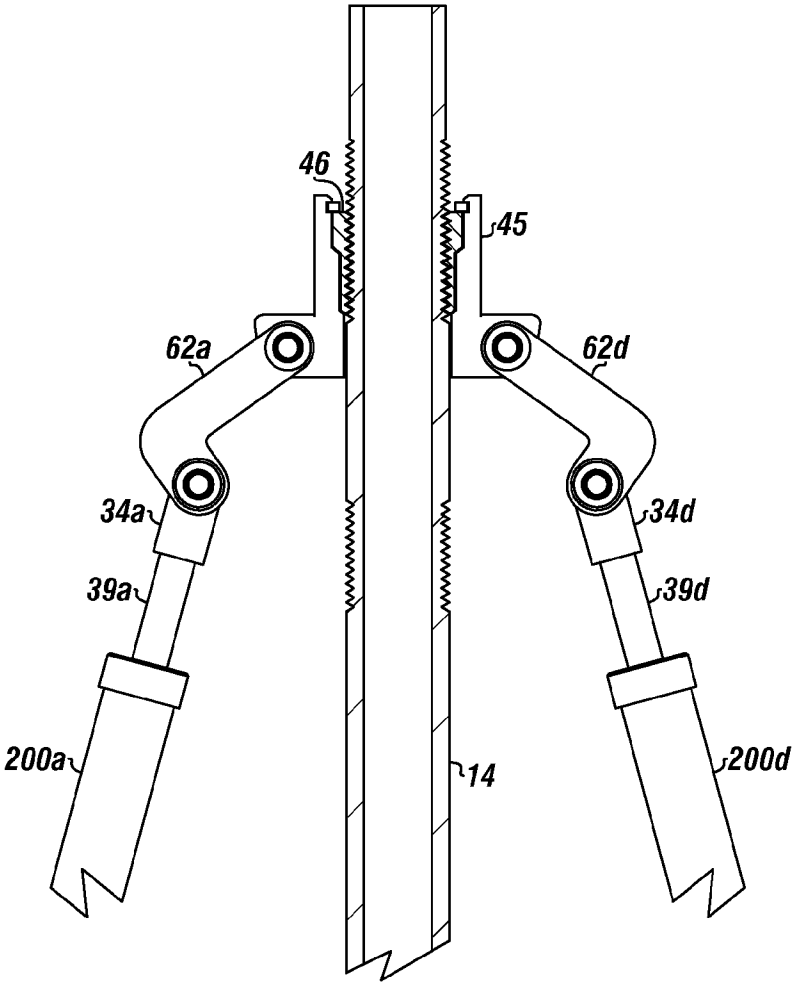
FIG. 9 depicts the short pivoting push arms in another position.

FIG. 9 depicts the short pivoting push arms 62*a* and 62*d* in another position.

Cylinder piston rods 39*a* and 39*d* can extend from barrels 200*a* and 200*d* respectively.

The hydraulic cylinders are in an "A" frame or cone configuration with short pivoting push arms 62*a* and 62*d* secured to the riser push bowl 45 in a retracted or relaxed position to allow the hydraulic cylinders to be swung out on their respective pivot arms secured on the lower end of the cylinders.

The ribbed ring 46 can secure to teeth on the riser 14. Upper hubs 34*a* and 34*d* are also shown.

A benefit of the invention is that the hydraulic cylinders can be disassembled and assembled for maintenance without use of screws, bolts, nuts, wrenches or torque tools.

The invention can be used offshore for drilling and production platforms having one or more hydraulic cylinders installed in either a vertical up or vertical down arrangement around the riser or angled in in an "A" frame assembly.

In embodiments, one cylinder can be disassembled and repaired in place on the offshore platform while another cylinder in the system continues to apply tension to the riser.

The cylinders can be disconnected from the riser and repaired without the use of a crane, forklift or other heavy equipment.

In embodiments, the hydraulic cylinders can have upper and lower end caps connected to the barrel with segmented lock rings mounted on the hydraulic cylinder outer diameter. The segmented lock rings can have one or more circumferential teeth at each end of the inner diameter of the segmented lock ring which engages matching grooves on the outer diameter of both the cylinder barrel and the end cap. The segmented lock rings can be retained in place by a slip over retainer ring.

In embodiments, the lower end of the cylinders can be connected to and are retained by universal pivot assemblies connected to sliding deck plates.

In embodiments, the universal pivot assembly can have two outer lower hub assemblies mounted 180 degrees apart, each outer lower hub assembly supports a load and also supports the lower end of a vertically extending pivot arm. The upper end of the pivot arms can attach to upper hub assemblies at some distance apart from the lower hub assembly on the outer diameter of the barrel of the hydraulic cylinder. The pivot arms can react to the load on the bottom of the hubs and allow the cylinder to be swung radially outward from the riser to be repaired.

In embodiments, the riser tensioner system can have a lock notch on the lowest end of the pivot arms that engages spring detents on the deck plate when a pin that connects the hydraulic cylinder end cap to the universal pivot assembly at the sliding deck plate is removed and the lower end of the cylinder is pulled radially out from the riser. When pushed out, the detent can engage the lock notch and lock the lower end of the cylinder rigidly out.

In embodiment, the pivot arm can be unlocked and the hydraulic cylinder pulled away from its universal pivot assembly, enabling the lower end cap to be removed for replacing of the seals.

To remove a piston for repairs, a one piece retainer ring can be slid up the barrel and off of a segmented two piece teethed lock ring on the hydraulic cylinder outer diameter.

In another embodiment, the riser tensioner system can have a drill floor with circumferential grooves machined where a spider with pivoting push beams is attached.

In an embodiment, the moving tractor can be driven simultaneously upward and downward by an air gear motor with a pinion engaging the teeth of a vertical rack mounted to the riser.

The simultaneous dual movement of the moving tractor can also be accomplished with a winch and vertical track. In embodiments, the tractor can rotate 360 degrees to any cylinder.

In an embodiment, an attaching device can be used to attach a lock hub near an upper end of one of the cylinders to suspend the hydraulic cylinder when the cylinder rod is disconnected from the push beam of the spider.

The rod end of the piston, in embodiments, can be a hollow rod initially filled with a gas, such as nitrogen or air. The gas enables the cylinder piston rod to behave as a fast reaction accumulator wherein an inner diameter of the cylinder piston rod adds to the cylinder's total piston force area.

In embodiments, the rod's bore can extend through the piston.

In embodiments, the upper end of the inner diameter of a cylinder rod can add to the cylinder's total piston force area.

In embodiments, the hollow piston push rod can be pressurized to best resist buckling under compressive load.

While these embodiments have been described with emphasis on the embodiments, it should be understood that within the scope of the appended claims, the embodiments might be practiced other than as specifically described herein.

What is claimed is:

1. A vertical style riser tensioner assembly comprising:

a. a riser mounted through an opening in at least one sliding deck plate and supported by a plurality of roller assemblies disposed around the riser, stabilizing the riser;

b. a spider mounted to the riser, the spider providing compressive upper tensile load transfer, the spider comprising:

(i) a spider retaining bracket surrounding the riser;

(ii) a plurality of pivoting push beams connected to the spider retaining bracket;

(iii) a riser tensile rod bracket mounted around the riser between the spider retaining bracket and each sliding deck plate; and (iv) a plurality of tensile rods, each tensile rod slidably engaging at least one pivoting push beam;

c. a plurality of hydraulic cylinders, each hydraulic cylinder comprising:

(i) a barrel;

(ii) a cylinder piston rod sliding in the barrel, engaging at least one pivoting push beam of the spider; and (iii) an end cap mounted to each hydraulic cylinder;

d. a plurality of hub assemblies, each hub assembly surrounding the barrel of one of the hydraulic cylinders;

e. a moving tractor movably mounted to the riser between the spider and one of the sliding deck plates;

f. an air gear motor mounted to the riser and connected to the moving tractor for moving individually selectable hydraulic cylinders between an operational location to a maintenance location, wherein the air gear motor is connected to at least one system accumulator that supplies gas to each hydraulic cylinder to extend or retract the cylinder piston rod in the barrel;

g. a plurality of pivot arms connected between one of the hub assemblies and a universal pivot assembly which is mounted to one of the sliding deck plates, each pivot arm moving in tandem with the moving tractor for moving the hydraulic cylinders between the operational location and the maintenance location;

h. a plurality of upper hubs, each upper hub surrounding the barrel of one of the hydraulic cylinders, to suspend the hydraulic cylinders when the cylinder piston rod is disconnected from the at least one pivoting push beam of the spider; and i. a plurality of disconnectable arms, wherein each disconnectable arm connects between one of the upper hubs of the hydraulic cylinder and the moving tractor, enabling the at least one pivoting push beam of the spider to move enabling the cylinder piston rod to be retracted allowing the hydraulic cylinder to drop down and outward when each pivot arm is swung out without using the moving tractor.

2. The vertical style riser tensioner assembly of claim 1, comprising a rack mounted to the riser allowing the air gear motor and the moving tractor to move longitudinally along the riser.

3. The vertical style riser tensioner assembly of claim 1, comprising a lower hub mounted to each of the hydraulic cylinders engaging one of the pivot arms.

4. The vertical style riser tensioner assembly of claim 3, comprising a locking assembly retainer ring connected with a teethed lock ring for holding the end cap onto the barrel.

5. The vertical style riser tensioner assembly of claim 1, comprising a riser push bowl connected around the riser, the riser push bowl having a ribbed ring, the riser push bowl engages the cylinder piston rod, the ribbed ring locks to grooves in the riser.

6. The vertical style riser tensioner assembly of claim 1, comprising a plurality of top stabilizer beams connected between the riser and one side of the at least one sliding deck plate, and a plurality of bottom stabilizer beams connected between the riser and one side of the at least one sliding deck plate on a side opposite the top stabilizer beams.

7. The vertical style riser tensioner assembly of claim 1, comprising a bump ring to absorb shock if the cylinder piston rod bottoms out in the hydraulic cylinder against the end cap.

8. The vertical style riser tensioner assembly of claim 1, comprising a plurality of rod bearing end caps, each rod bearing end cap connected to one of the barrels with a two piece teethed lock ring retained by one piece retainer ring.

9. The vertical style riser tensioner assembly of claim 1, comprising a lock notch on the lowest end of each of the pivot arms, the lock notch engaging spring actuated detent pins on the at least one sliding deck plate when a retainer pin that connects the end cap to a universal pivot assembly at the at least one sliding deck plate is removed and the lower end of the hydraulic cylinder is moved radially out from the riser, the spring actuated detent pin engages the lock notch and locks the disconnected end of the hydraulic cylinder rigidly out away from the riser.

10. The vertical style riser tensioner assembly of claim 1, comprising a lock notch for locking and unlocking one of the pivot arms to the hydraulic cylinder, enabling the hydraulic cylinder to be pulled away from one of the universal pivot assemblies, enabling the end cap to be removed for replacing of seals in the hydraulic cylinder.

11. The vertical style riser tensioner assembly of claim 1, comprising a plurality of stops, one for each pivoting push beam, and when the stops are engaged, a rigid lift frame for the riser is formed by interlocking the plurality of tensile rods with the plurality of pivoting push beams.

12. The vertical style riser tensioner assembly of claim 1, wherein the moving tractor is configured to rotate 360 degrees to any hydraulic cylinder.

13. The vertical style riser tensioner assembly of claim 1, comprising forming the plurality of hydraulic cylinders in an arrangement, wherein each cylinder piston rod is slanted inward to the riser in a cone configuration.

14. The vertical style riser tensioner assembly of claim 1, comprising a plurality of short pivoting push arms connected to the riser push bowl in a relaxed position to allow the hydraulic cylinder to be swung out on the pivot arms.

15. The vertical style riser tensioner assembly of claim 14, comprising a plurality of rod end clevises attached to the cylinder piston rods, each rod end clevis engaging a clevis pin, wherein each clevis pin engages one of the short pivoting push arms, wherein each short pivoting push arm is adapted to push the hydraulic cylinder outward and away from the riser allowing a lower end of the hydraulic cylinder to pivot outward with the short pivoting push arm.

16. The vertical style riser tensioner assembly of claim 1, comprising a gas of at least one of: nitrogen and air, to enable the cylinder piston rod to behave as a fast reaction accumulator wherein an inner diameter of the cylinder piston rod adds to the hydraulic cylinder's total piston force area.

* * * * *